US009681714B1

(12) United States Patent
Yeh

(10) Patent No.: US 9,681,714 B1
(45) Date of Patent: Jun. 20, 2017

(54) AUTOMATIC DIRECTION-CORRECTING APPARATUS FOR A CANE

(71) Applicant: Superior Mechanical Solutions Corp., Taichung (TW)

(72) Inventor: Heng-Wei Yeh, Taichung (TW)

(73) Assignee: Superior Mechanical Solutions Corp., Taichung (TW)

( * ) Notice: Subject to any disclaimer, the term of this patent is extended or adjusted under 35 U.S.C. 154(b) by 0 days.

(21) Appl. No.: 15/349,034

(22) Filed: Nov. 11, 2016

(51) Int. Cl.
*A45B 9/04* (2006.01)
*A45B 9/02* (2006.01)
*A45B 9/00* (2006.01)

(52) U.S. Cl.
CPC ..... *A45B 9/04* (2013.01); *A45B 9/02* (2013.01); *A45B 2009/005* (2013.01)

(58) Field of Classification Search
CPC ..... A61H 3/02; A61H 3/0288; A45B 1/00; A45B 9/02; A45B 9/04; A45B 3/00; A45B 3/12; A45B 2009/005; A45B 2009/007
USPC ..... 135/65–66, 68, 75, 77, 82, 84
See application file for complete search history.

(56) References Cited

U.S. PATENT DOCUMENTS 679,468 A * 7/1901 Pratt ..... A61H 3/0288 114/79 R
710,074 A * 9/1902 Pratt ..... A61H 3/0288 135/84
1,061,397 A * 5/1913 Newell ..... A61H 3/0288 135/78
2,513,193 A * 6/1950 Miller ..... A47B 91/04 16/38
3,065,494 A * 11/1962 Kramcsak, Jr. ..... A47B 91/066 16/42 R
4,098,283 A * 7/1978 Tritle, Jr. ..... A61H 3/0288 135/77
4,708,154 A * 11/1987 Edwards ..... A61H 3/0288 135/84
5,865,204 A * 2/1999 Bracy ..... A45B 9/04 135/82
6,883,530 B2 * 4/2005 Kawakami ..... A45B 9/04 135/82
7,637,274 B1 * 12/2009 Dodson ..... A61H 3/0277 135/84
7,784,753 B2 * 8/2010 Andreoli ..... F16M 7/00 248/188.8
8,166,990 B2 * 5/2012 Daily ..... A45B 7/00 135/65

* cited by examiner

*Primary Examiner* — Winnie Yip
(74) *Attorney, Agent, or Firm* — Alan D. Kamrath; Kamrath IP Lawfirm, P.A.

(57) ABSTRACT

A cane includes a tube and a direction-correcting apparatus including a sleeve, a gasket, a pad unit and a connector unit. The sleeve receives the tube and includes an annular shoulder on an internal face. The gasket is inserted in the sleeve. The pad unit includes a dome in contact with the gasket, an aperture in the dome, and a flat face around the aperture. The connector unit includes a threaded bolt, a nut engaged with the threaded bolt and connected to the tube, and a spring compressed between the nut and the annular shoulder. The threaded bolt includes a head at an end of the shank. The shank is inserted in the sleeve via the aperture of the pad unit. The head includes a flat upper face for contact with the flat face of the dome when the head is inserted in the dome.

10 Claims, 6 Drawing Sheets

AUTOMATIC DIRECTION-CORRECTING APPARATUS FOR A CANE

BACKGROUND OF INVENTION

1. Field of Invention

The present invention relates to a cane and, more particularly, to an automatic direction-correcting apparatus for a cane.

2. Related Prior Art

Referring to FIG. 1, a conventional cane 1 includes a pad 3 attached to a lower end of a tube 2 in a fixed manner. That is, the tube 2 cannot be moved relative to the pad 3. When a person walks with help from the cane 1, the cane 1 may or may not extend perpendicular to a floor. When the cane 1 extends perpendicular to the floor, an entire lower face of the pad 3 contacts the floor so that the pad 3 does not slip on the floor. Hence, the cane 1 provides firm support for the user. However, when the cane 1 does not extend perpendicular to the floor, only a portion of the lower face of the pad 3 contacts the floor so that the pad 3 might slip on the floor. Hence, the cane 1 does not provide firm support for the user.

The present invention is therefore intended to obviate or at least alleviate the problems encountered in prior art.

SUMMARY OF INVENTION

It is the primary objective of the present invention to provide a reliable cane.

To achieve the foregoing objective, the cane includes a tube and an automatic direction-correcting apparatus including a sleeve, a gasket, a pad unit and a connector unit. The sleeve receives the tube and includes an annular shoulder on an internal face. The gasket is inserted in the sleeve. The pad unit includes a dome in contact with the gasket, an aperture in the dome, and a flat face around the aperture. The connector unit includes a threaded bolt, a nut engaged with the threaded bolt and connected to the tube, and a spring compressed between the nut and the annular shoulder. The threaded bolt includes a head at an end of the shank. The shank is inserted in the sleeve via the aperture of the pad unit. The head includes a flat upper face for contact with the flat face of the dome when the head is inserted in the dome.

In another aspect, the sleeve includes a conical face, an annular edge and a stepped space. The conical face is in compliance with an external face of the dome. Then annular edge extends around the conical face. The stepped space is made by the conical face and the annular edge. The gasket is inserted in the stepped space and placed against the annular edge.

In another aspect, the annular edge includes a chamfer separated from the dome by a gap.

In another aspect, the dome is separated from the conical face of the sleeve by a gap.

In another aspect, the gasket includes a rounded contact face in contact with the dome.

In another aspect, the aperture is in the form of a conical frustum that gets larger toward the sleeve.

In another aspect, the pad unit further includes an annular wall extending from the dome and a pad connected to the annular wall.

In another aspect, the pad includes a flat lower face.

Advantageously, the dome is in contact with the gasket so that the sleeve can be pivoted relative to the dome. Thus, the tube can be pivoted relative to the pad unit. Therefore, the entire lower face of the pad unit can be in contact with a floor no matter the tube is placed perpendicular to the floor or not.

Other objectives, advantages and features of the present invention will be apparent from the following description referring to the attached drawings.

BRIEF DESCRIPTION OF DRAWINGS

The present invention will be described via detailed illustration of the preferred embodiment versus the prior art referring to the drawings wherein.

DETAILED DESCRIPTION OF PREFERRED EMBODIMENT

Figure 1:
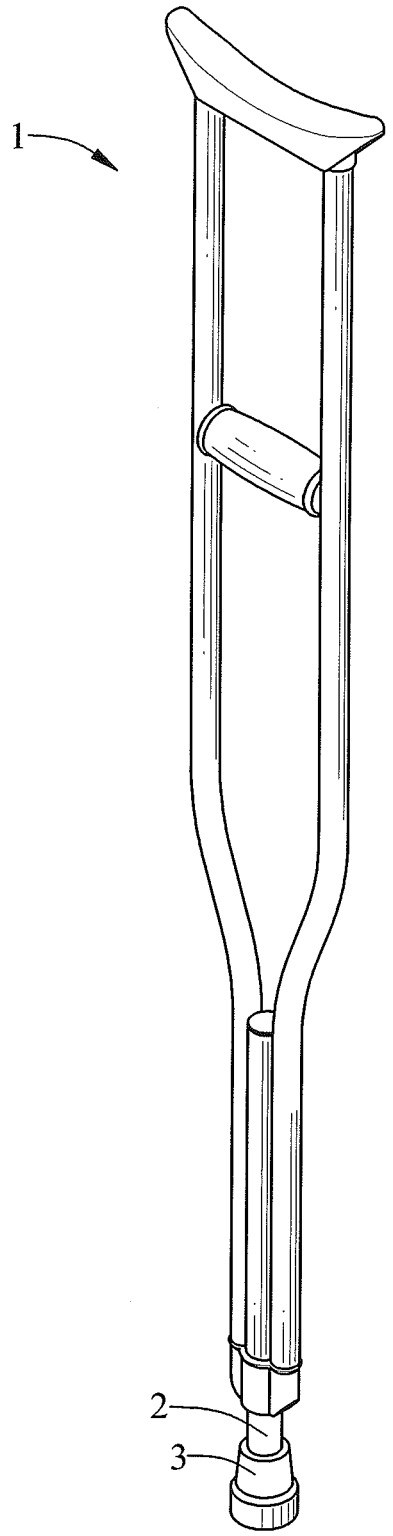
FIG. 1 PRIOR ART
FIG. 1 is a perspective view of a conventional cane.
Figure 2:
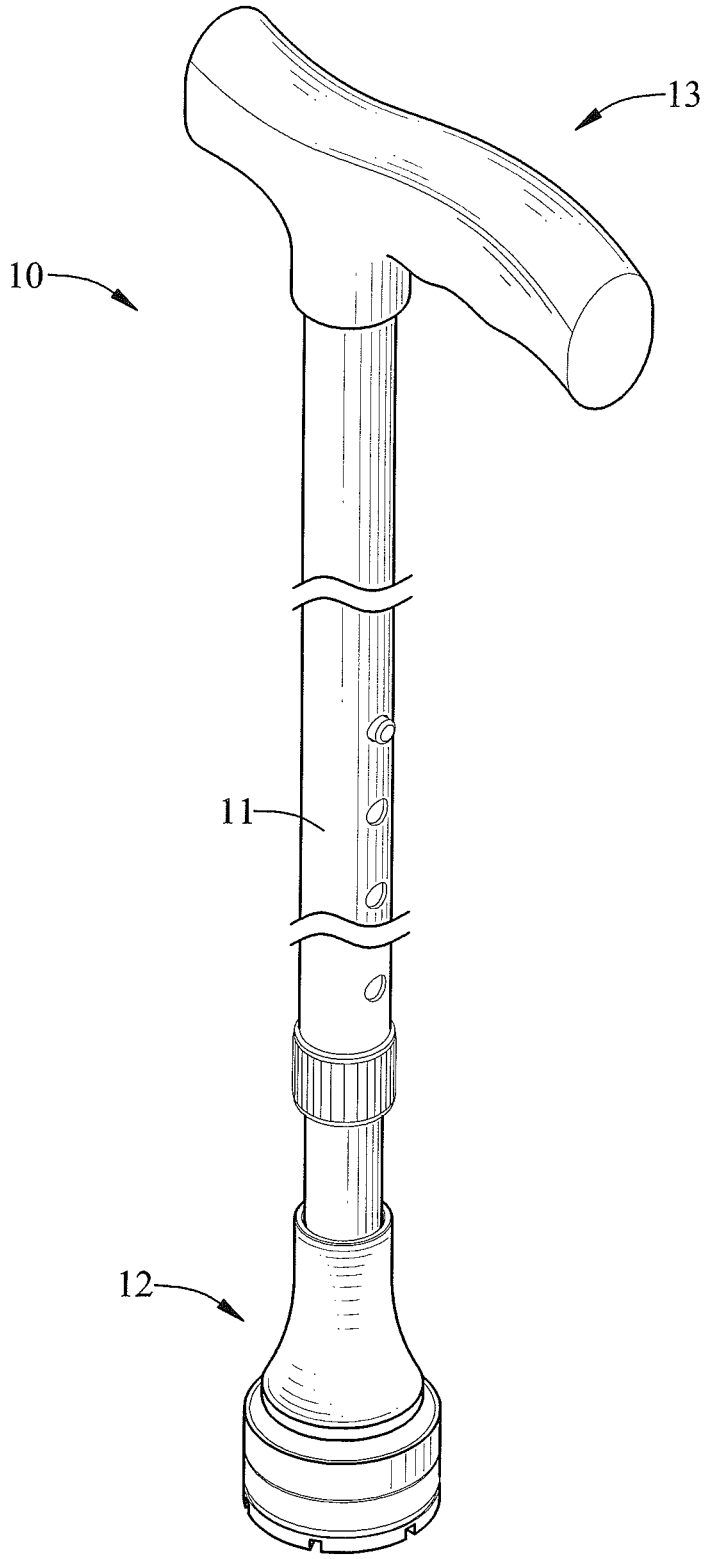
FIG. 2 is a perspective view of cane equipped with an automatic direction-correcting apparatus according to the preferred embodiment of the present invention.
Figure 3:
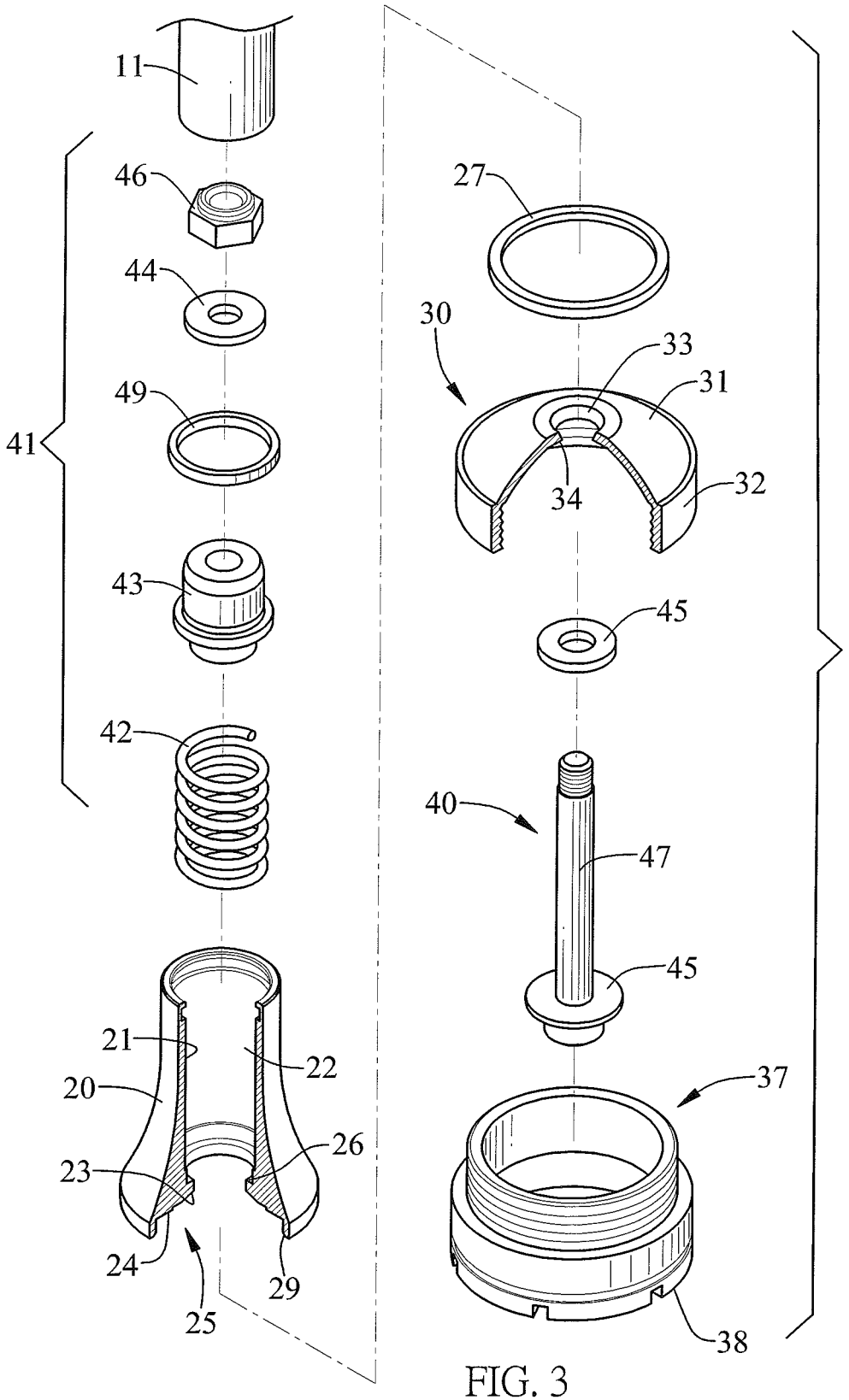
FIG. 3 is an exploded view of the automatic direction-correcting apparatus shown in FIG. 2.
Figure 4:
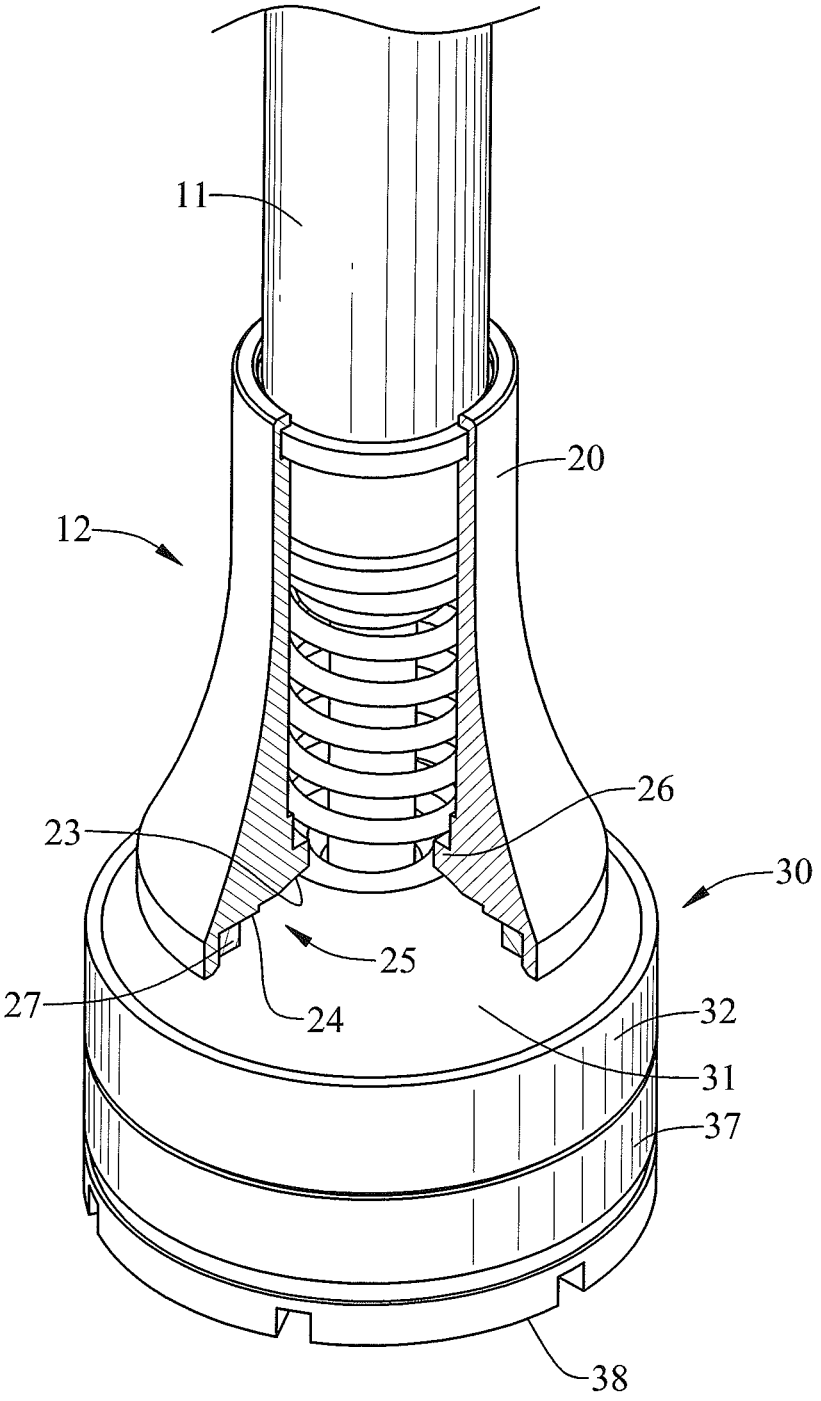
FIG. 4 is a perspective view of the automatic direction-correcting apparatus shown in FIG. 3.

Referring to FIGS. 2 through 5, a cane 10 includes a tube 11, an automatic direction-correcting apparatus 12 attached to a lower end of the tube 11 and a handle 13 attached to an upper end of the tube 11. The automatic direction-correcting apparatus 12 includes a sleeve 20, a pad unit and a connector unit 41 according to the preferred embodiment.

Figures 5, 7, 8:
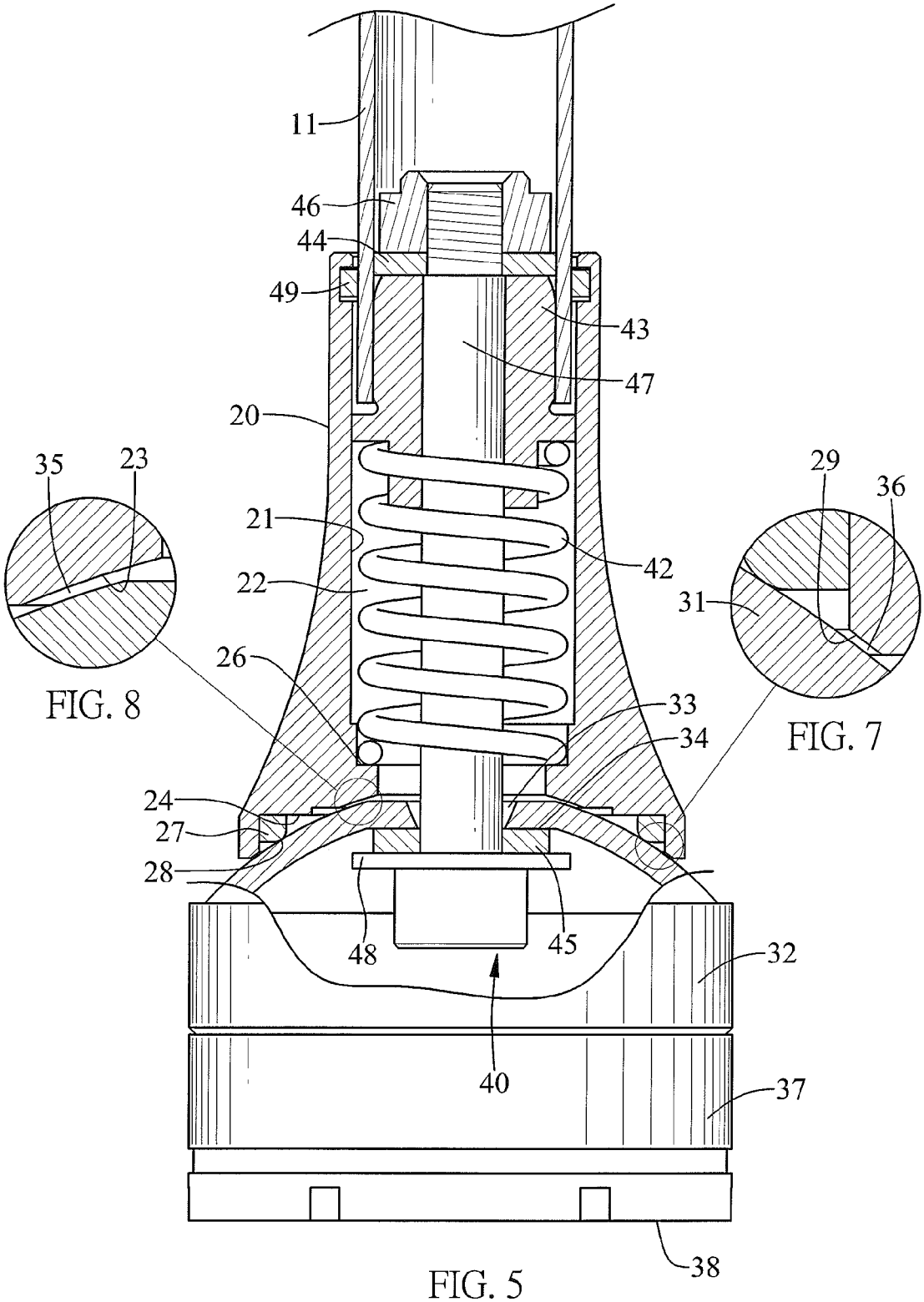
FIG. 5 is a cross-sectional view of the automatic direction-correcting apparatus shown in FIG. 4
FIG. 7 is an enlarged partial view of the automatic direction-correcting apparatus shown in FIG. 5.
FIG. 8 is another enlarged partial view of the automatic direction-correcting apparatus shown in FIG. 5.

The sleeve 20 includes a tubular wall 21 formed with an internal face, an external face and a lower face. The internal face of the tubular wall 21 provides a cylindrical space 22 axially extending throughout the sleeve 20 so that the sleeve 20 or, more particularly, the tubular wall 21 includes an opening at an upper end and another opening at the lower end. The external face of the tubular wall 21 expands from the upper end to the lower end. That is, the tubular wall 21 gets thicker from the upper end to the lower end. The lower face of the tubular wall 21 extends substantially perpendicular to the internal face of the tubular wall 21. The lower face of the tubular wall 21 includes a conical face 23. An annular edge 24 extends on the lower face of the tubular wall 21, around the conical face 23. The annular edge 24 includes a chamfer 29 on an internal side (FIG. 7). The conical face 23 and the annular edge 24 together make a stepped space 25 in communication with the cylindrical space 22. An annular shoulder 26 extends on the internal face of the tubular wall 21 near the lower end.

There is a gasket 27 made of a wear-resistant material. The gasket 27 is in the form of a ring that includes a rounded contact face 28 on an internal side at a lower end (FIG. 8).

The pad unit includes a cover 30 and a pad 37. The cover 30 includes a dome 31 and an annular wall 32. The dome 31 includes an aperture 33 at the center. The aperture 33 gets smaller from an upper end to a lower end. A flat face 34 extends around the aperture 33. The annular wall 32 includes a thread (not numbered) on an internal face.

The pad 37 is a hollow element that includes, on an external side, a thread (not numbered) corresponding to that of the annular wall 32. The pad 37 further includes a flat lower face 38 for contact with a floor in operation.

The connector unit 41 includes a threaded bolt 40, a spring 42, an end element 43, two washers 44 and 45, a nut 46 and a seal 49. The threaded bolt 40 includes a shank 47, a thread (not numbered) formed at an upper end of the shank 47, and a head 48 formed at a lower end of the shank 47. The head 48 is formed with an annular flange (not numbered). The spring 42 is preferably a helical spring. The end element 43 is a tubular element that includes an annular flange (not numbered) on an external face between two ends. The washer 45 includes a flat upper face. The seal 49 is in the form of a ring and preferably made of rubber.

In assembly, the shank 47 is inserted in the washer 45 and the aperture 33 of the dome 31 before the thread of the cover 30 is engaged with the thread of the pad 37 to connect the cover 30 to the pad 37. Thus, the washer 45 and the head 48 of the threaded bolt 40 are placed in the cover 30. The washer 45 is placed on the head 48 of the threaded bolt 40.

The gasket 27 is inserted in the opening at the lower end of the sleeve 20 and placed against the annular edge 24. The sleeve 20 is placed around the shank 27 so that a portion of the dome 31 is inserted in the stepped space 25 of the sleeve 20. The gasket 27 is placed between the lower face of the sleeve 20 and an external or upper face the dome 31. The rounded contact face 28 of the gasket 27 is in contact with an internal or lower face of the dome 31. Referring to FIG. 7, the chamfer 29 of the annular edge 24 is separated from the external face of the dome 31 by a gap 36. Referring to FIG. 8, the conical face 23 of the tubular wall 21 is separated from the external face of the dome 31 by a gap 35.

The spring 42 is placed around the shank 47 and inserted in the sleeve 20 so that a lower end of the spring 42 is placed on the annular shoulder 26. The end element 43 is inserted in the sleeve 20 and placed around the shank 47 so that a lower section of the end element 43 is inserted in an upper end of the spring 42 and that the flange of the end element 43 is placed on the upper end of the spring 42. The washer 44 is placed around the shank 47 and on an upper section of the end element 43. The nut 46 is placed on the washer 44 and engaged with the threaded bolt 40. Thus, the spring 42 is compressed between the annular flange of the end element 43 and the annular shoulder 26 of the sleeve 20. Moreover, the upper face of the washer 45 is biased against the flat face 34 of the dome 31.

The seal 49 is inserted in an annular groove (not numbered) made in the internal face of the sleeve 20 near the upper end. The tube 11 is inserted in the opening at the upper end of the sleeve 20. The seal 49 is placed between the external face of the tube 11 and the internal face of the sleeve 20. The upper section of the end element 43 is fitted in a lower end of the tube 11 so that the end element 43 is connected to the tube 11. Hence, the automatic direction-correcting apparatus 12 is attached to the tube 11. The flange of the end element 43 is placed against the lower end of the tube 11.

The dome 31 is contact with the gasket 27 so that the sleeve 20 can be pivoted relative to the dome 31. The tube 11 is connected to the sleeve 20 via the connector unit 41. Hence, the tube 11 can be pivoted relative to the dome 31. That is, the cane 10 can be pivoted relative to the pad unit.

Figure 6:
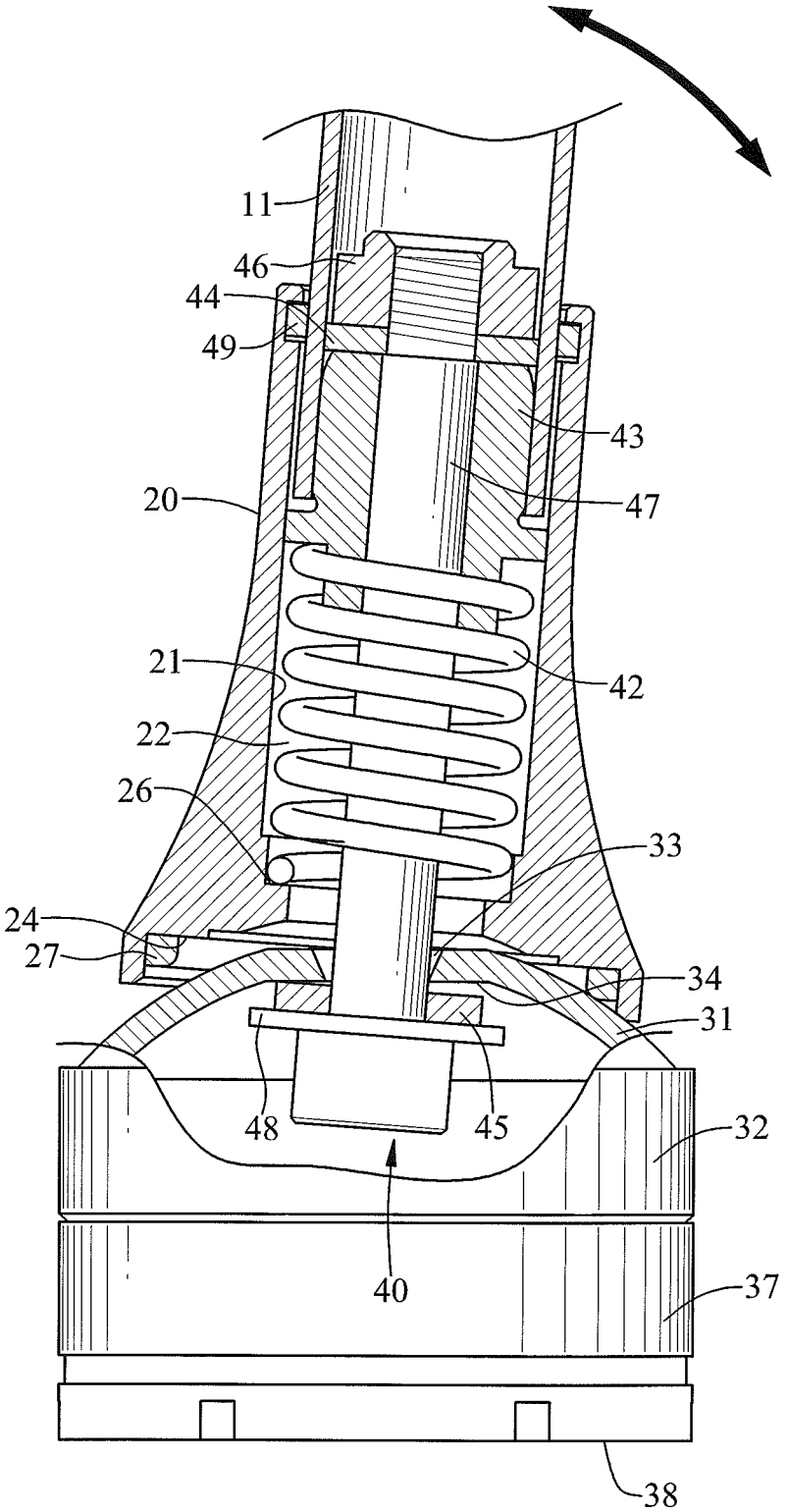
FIG. 6 is a cross-sectional view of the automatic direction-correcting apparatus in another position than shown in FIG. 5.

Referring to FIG. 6, the entire flat lower face 38 of the pad 37 is in contact with a floor while the tube 11 does not extend perpendicular to the floor due to the use of the connector unit 41. Now, the threaded bolt 40 does not extend perpendicular to the flat face 34 of the dome 31. The washer 45 is tilted with the threaded bolt 40 so that only a portion of an upper face of the washer 45 is in contact with the flat face 34. The spring 42 is further compressed and hence loaded.

Referring to FIG. 5, when the automatic direction-correcting apparatus 12 is taken from the floor, the spring 42 turns the automatic direction-correcting apparatus 12 back to the normal position relative to the tube 11. Thus, the entire upper of the washer 45 is in contact with the flat face 34 of the dome 31 again, and the threaded bolt 40 extends perpendicular to the flat lower face 38 of the pad unit again.

Advantageously, the use of the flat face 34 of the dome 31 and the washer 45 facilitate the spring 42 to return the automatic direction-correcting apparatus 12 to the position shown in FIG. 5 from the position shown in FIG. 6 as the automatic direction-correcting apparatus 12 is away from the floor. Therefore, the direction-correcting apparatus 12 is ready for contact with the floor again.

The use of the washer 45 is preferred. However, in another embodiment, the washer 45 can be omitted if the head 48 is formed with a flat upper face and made larger than the aperture 33.

The use of the end element 43 is preferred. However, in another embodiment, the end element 43 can be omitted if the nut 46 and the tube 11 are shaped corresponding to each other and the nut 46 is fitted in the tube 11.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cane comprising a tube (11) and an automatic direction-correcting apparatus (12) connected to the tube (11), characterized in that the automatic direction-correcting apparatus (12) comprises:

- a sleeve (20) receiving the tube (11) and comprising an annular shoulder (26) formed on an internal face;
- a gasket (27) inserted in the sleeve (20);
- a pad unit comprising:
  - a dome (31) in contact with the gasket (27);
  - an aperture (33) made in the dome (31); and
  - a flat face (34) extending around the aperture (33); and
- a connector unit (41) comprising:
  - a threaded bolt (40) comprising:
    - a shank (47) inserted in the sleeve (20) via the aperture (33) of the pad unit; and
    - a head (48) formed at an end of the shank (47) and made with a flat upper face for contact with the flat face (34) of the dome (31) when the head (48) is inserted in the dome (31);
  - a nut (46) engaged with the threaded bolt (40) and connected to the tube (11); and
  - a spring (42) compressed between the nut (46) and the annular shoulder (26).

2. The cane according to claim 1, wherein the connector unit (41) further comprises a washer (45) placed on the shank (47), between the head (48) and the flat face (34) of the pad unit, and in contact with the flat face (34).

3. The cane according to claim 1, wherein the connector unit (41) further comprises an end element (43) fitted in the tube (11) and placed against the nut (46), wherein the spring (42) is compressed between the end element (43) and the annular shoulder (26).

4. The cane according to claim 1, wherein the sleeve (20) comprises:

- a conical face (23) in compliance with an external face of the dome (31);

an annular edge (24) extending around the conical face (23); and a stepped space (25) made by the conical face (23) and the annular edge (24), wherein the gasket (27) is inserted in the stepped space (25) and placed against the annular edge (24).

5. The cane according to claim 4, wherein the annular edge (24) comprises a chamfer (29) separated from the dome (31) by a gap (36).

6. The cane according to claim 4, wherein the dome (31) is separated from the conical face (23) of the sleeve (20) by a gap (35).

7. The cane according to claim 1, wherein the gasket (27) comprises a rounded contact face (28) in contact with the dome (31).

8. The cane according to claim 1, wherein the aperture (33) is in the form of a conical frustum that gets larger toward the sleeve (20).

9. The cane according to claim 1, wherein the pad unit further comprises an annular wall (32) extending from the dome (31) and a pad (37) connected to the annular wall (32).

10. The cane according to claim 9, wherein the pad (37) comprises a flat lower face (38).

* * * * *